US008882562B2

(12) United States Patent
Thomas et al.

(10) Patent No.: US 8,882,562 B2
(45) Date of Patent: Nov. 11, 2014

(54) SCRATCH REMOVAL AND DEVICE AND METHOD

(75) Inventors: Jonathan P. Thomas, Maple Lake, MN (US); Keith A. Beveridge, Edina, MN (US); Chad J. Olson, Blaine, MN (US)

(73) Assignee: TCG International Inc., Burnaby (CA)

( * ) Notice: Subject to any disclaimer, the term of this patent is extended or adjusted under 35 U.S.C. 154(b) by 1247 days.

(21) Appl. No.: 12/665,912

(22) PCT Filed: Jun. 20, 2008

(86) PCT No.: PCT/US2008/067684

§ 371 (c)(1), (2), (4) Date: Nov. 12, 2010

(87) PCT Pub. No.: WO2009/014836

PCT Pub. Date: Jan. 29, 2009

(65) Prior Publication Data

US 2011/0045743 A1 Feb. 24, 2011

Related U.S. Application Data

(60) Provisional application No. 60/937,248, filed on Jun. 25, 2007.

(51) Int. Cl.

| | |
|---|---|
| ***B24B 49/00*** | (2012.01) |
| ***B24B 57/02*** | (2006.01) |
| ***B24B 37/04*** | (2012.01) |

(52) U.S. Cl.

CPC ..... *B24B 37/04* (2013.01); *B24B 57/02* (2013.01)

USPC ..... 451/7; 451/5; 451/359

(58) Field of Classification Search

USPC ..... 451/7, 359, 5

See application file for complete search history.

(56) References Cited

U.S. PATENT DOCUMENTS

| | | | |
|---|---|---|---|
| 1,987,810 | A | 1/1935 | White |
| 2,163,687 | A | 6/1939 | Jacobsen |
| 2,169,387 | A | 8/1939 | Hann |

(Continued)

FOREIGN PATENT DOCUMENTS

| | | |
|---|---|---|
| JP | 2002-120142 | 4/2002 |
| JP | 2003-251555 | 9/2003 |
| JP | 2003-311397 | 11/2003 |

OTHER PUBLICATIONS

European Search Report for Application No. 08771604.9 mailed Nov. 30, 2012.

(Continued)

*Primary Examiner* — Maurina Rachuba

(74) *Attorney, Agent, or Firm* — Merchant & Gould P.C.

(57) ABSTRACT

A scratch removal tool that includes a motor, a housing, a rotatable shaft operably coupled to the motor and movable in an axial direction along a length of the shaft, and a head assembly. The head assembly includes a shroud member having an open end, a pad member, a slurry input, a slurry output, and a seal member. The pad member is positioned within the shroud and mounted to the shaft. Rotation of the shaft rotates the pad member. Axial movement of the shaft moves the pad member relative to the open end of the shroud. The slurry input and slurry are in fluid communication with the pad member. The seal member is positioned at the open end of the shroud.

48 Claims, 8 Drawing Sheets

(56) References Cited

U.S. PATENT DOCUMENTS

| | | | | | |
|---|---|---|---|---|---|
| 2,384,225 | A | | 9/1945 | Wilson | |
| 2,606,747 | A | | 8/1952 | Williams | |
| 3,191,402 | A | | 6/1965 | Baker | |
| 3,859,812 | A | | 1/1975 | Pavlak | |
| 3,880,047 | A | * | 4/1975 | Dosier | 451/359 |
| 4,091,580 | A | | 5/1978 | Oates | |
| 4,201,262 | A | | 5/1980 | Goldstein | |
| 4,622,780 | A | * | 11/1986 | Tingley | 451/359 |
| 4,709,513 | A | * | 12/1987 | Tingley | 451/359 |
| 6,200,206 | B1 | | 3/2001 | Drees | |
| 6,533,648 | B2 | | 3/2003 | Drees | |
| 6,672,940 | B1 | * | 1/2004 | Graham | 451/7 |
| 6,827,633 | B2 | | 12/2004 | Wada et al. | |
| 7,137,872 | B1 | | 11/2006 | Thomas et al. | |
| 7,247,083 | B2 | | 7/2007 | Miyashita et al. | |
| 8,123,592 | B2 | * | 2/2012 | D'Alessandro et al. | 451/7 |
| 2007/0077865 | A1 | | 4/2007 | Dysard et al. | |

OTHER PUBLICATIONS

Declaration of Jonathan P. Thomas with Exhibits A-D dated Jan. 17, 2014.

* cited by examiner

SCRATCH REMOVAL AND DEVICE AND METHOD

This application is being filed on 21 Dec. 2009, as a US National Stage of PCT International Patent application No. PCT/US2008/067684, filed 20 Jun. 2008 in the name of TCG International, Inc., a Canadian national corporation, applicant for the designation of all countries except the US, and Jonathan P. Thomas, Keith A. Beveridge, and Chad J. Olson, all citizens of the U.S., applicants for the designation of the US only, and claims priority to U.S. Provisional patent application Ser. No. 60/937,248, filed Jun. 25, 2007. To the extent appropriate, a claim of priority is made to each of the above disclosed applications.

FIELD OF THE INVENTION

The present disclosure relates to an apparatus and methods for removing scratches from smooth surfaces such as glass.

BACKGROUND

Rotary tools are used to grind and polish glass to remove scratches and other damage from the surface of the glass. After processing the glass, such as windshields, it is desirable to leave the glass so the scratch or other damage is less visible and/or less likely to affect viewing through the glass. U.S. Pat. Nos. 4,709,513 and 4,622,780 show various tools for use in polishing glass.

Further improvements are desired for the rotary tools and methods used to polish glass.

SUMMARY

The present disclosure generally relates to scratch removal system and related methods. In one aspect, the present disclosure relates to a scratch removal system that includes a slurry cooling system. Another aspect of the present disclosure relates to a scratch removal tool that includes a DC brushless motor. A further aspect relates to a slurry pumping system for use with a scratch removal system. Other aspects are directed to methods of operating a scratch removal system and methods of polishing a surface using a scratch removal system.

DETAILED DESCRIPTION

Figure 1:
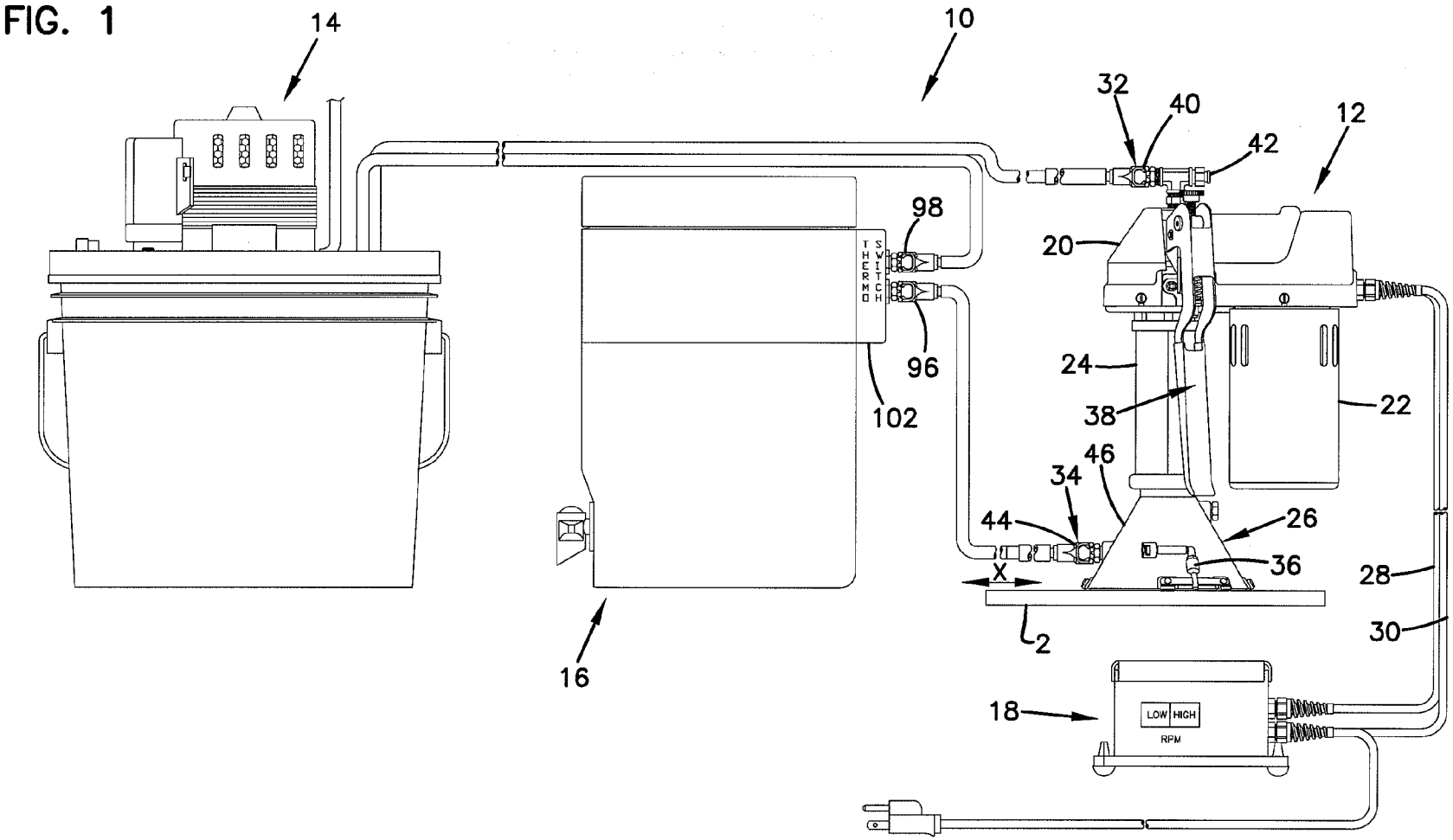
FIG. 1 is a side view of an example scratch removal system in accordance with the present disclosure.

The present disclosure relates to a system that can be used for removing localized scratches in smooth surfaces, including surfaces that are contoured, such as windshields. The system includes a scratch removal tool, a slurry pumping system and a controller. The system can optionally include a slurry cooling system. The scratch removal tool includes a power driven, high speed rotating shaft that can drive a selected type of grinding or polishing pad. The pad is housed inside of a generally conical shroud. A vacuum is supplied to the interior of the shroud to hold the shroud onto the polishing surface under vacuum force. The scratch removal tool also provides for a flow of polishing slurry across a polishing surface of the pad. The slurry pumping system provides the vacuum that holds the shroud in place. The slurry pumping system also promotes the flow of the polishing slurry through the scratch removal tool. The controller controls some operations of the system including the power supply and rpm (revolutions per minute) of the scratch removal tool motor. The slurry cooling system can reduce the temperature of the slurry provided to the scratch removal tool.

The present disclosure relates to two separate types of rotating scratch removal tools: a polisher and a finer. Both types of tools can use a common housing and motor, but use different pads and pad mounting structures to provide unique rotary movement of the pad for each type of tool. A quick change chuck can be used for interchanging the pads or pad mounting structures needed for each type of tool. Alternatively, a different shaft and associated pad and pad mounting structure The finer configuration for the scratch removal tool includes an orbital pad arrangement that moves in an orbital path within the shroud relative to the central axis of the drive shaft. In a "fining" operation, the slurry is typically fed through a sidewall of the shroud and is available for engagement with the polishing surface of the pad. The type of pad, supply of slurry, and orbital motion of the pad used in the finer configuration promote removal of large amounts of material from the surface being worked in a relatively short amount of time.

The polishing configuration for the scratch removal tool provides rotation of the pad within the shroud concentric with rotation of the shaft. In a "polishing" operation, the slurry is typically provided down a core of the shaft to a central point on the polishing surface of the pad. The slurry moves radially outward from the central point of the polishing surface of the pad under centrifugal forces created as the pad rotates. The polishing operation is typically a final step of a scratch removal process.

In both operations, the scratch removal tool is capable of being moved laterally along the surface being polished as the pad rotates without breaking the vacuum seal between the shroud and the surface being polished. The engagement of the pad with the surface being polished is controlled manually so that the tool can be gradually lowered in a direction perpendicular to the surface being polished as the tool is moving laterally to insure a smooth transition from an unworked portion of the surface being polished to a polished portion of the surface being polished.

Further details related to the operation and structure of finer and polishing configurations including various pad constructions for the scratch removal system are described in U.S. Pat. Nos. 4,622,780; 4,709,513; and 7,137,872, published patent application US 2007/0077864, and pending patent application Ser. No. 11/810,219, filed on Jun. 5, 2007, titled SCRATCH REMOVAL DEVICE AND METHOD, which disclosures are incorporated by reference.

Example Scratch Removal System of FIGS. 1-6

An example scratch removal system 10 configured for a polishing operation is now described with reference to FIGS. 1-6. The system 10 includes a scratch removal tool 12, a slurry pumping system 14, a slurry chiller system 16, and a controller 18. The system 10 is configured as a portable system that preferably can be easily handled, transported, and operated by a single operator. The tool 12, slurry pumping system 14, and slurry chiller system 16 are coupled together with a number of quick connect/disconnect connectors that can provide easier assembly, disassembly and transportation of the system 10. It is possible to operationally remove the slurry chiller system 16 from the system 10 by physically removing the slurry chiller system 16 from the return line of the slurry pumping system 14. Alternatively, a bypass valve can be used at the inlet and outlet to the slurry chiller system 16 to provide bypassing of the slurry chiller system 16, as will be described in further detail below.

Polishing Scratch Removal Tool

The scratch removal tool 12 is configured as a polishing tool. The scratch removal tool 12 is shown in side, top, bottom and cross-sectional views with reference to FIGS. 1-6. The scratch removal tool 12 includes a housing 20, a motor 22, a shaft housing 24, and a head 26. A pair of control cables 28, 30 provide a source of power and provide electrical communication with the controller 18. A slurry input connector 32 is positioned on the housing 20. A slurry output connector 34 is positioned on the head 26. The scratch removal tool 12 further includes a lubricant nozzle 36 mounted on an exterior of the head 26, and actuator assembly 38 having an actuation lever 39 and a shaft bracket 41, and a drive shaft 52 defining an internal slurry bore 53.

Figure 3:
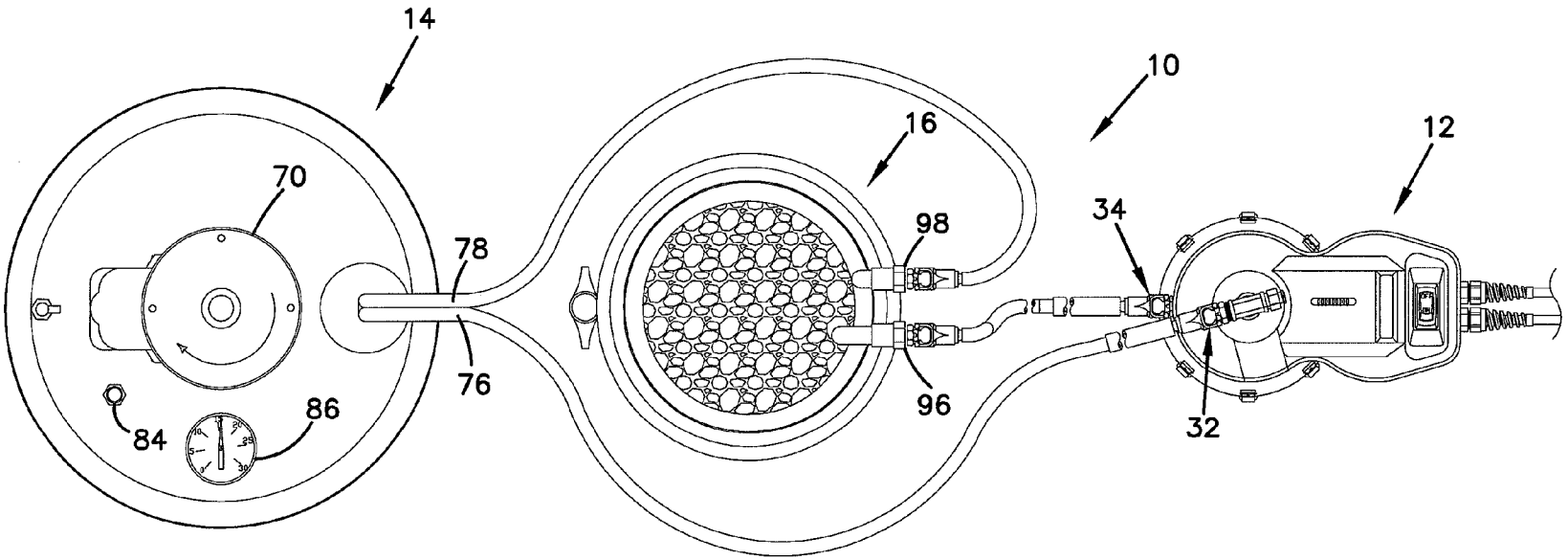
FIG. 3 is a top view of portions of the scratch removal system shown in FIG. 1.
Figure 5:
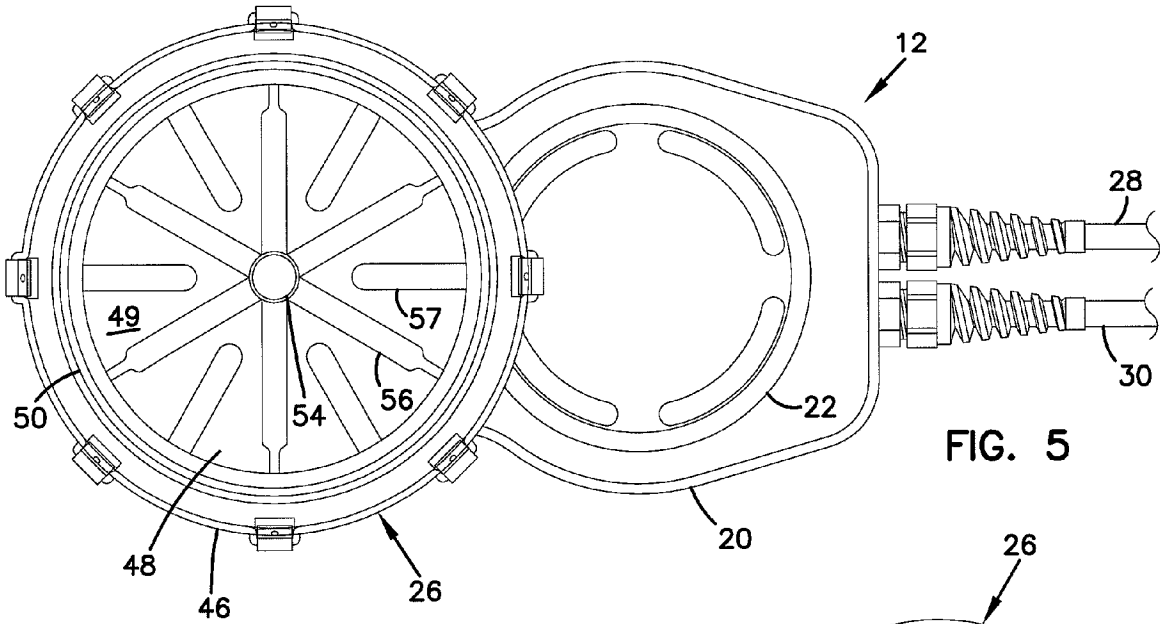
FIG. 5 is a bottom view of the scratch removal tool shown in FIG. 1.
Figure 4:
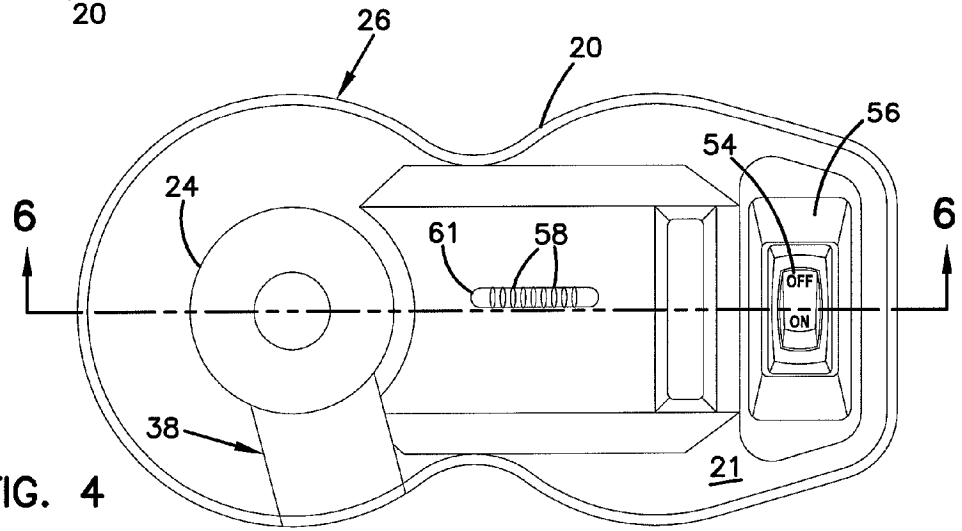
FIG. 4 is a top view of the scratch removal tool shown in FIG. 1.
Figure 7:
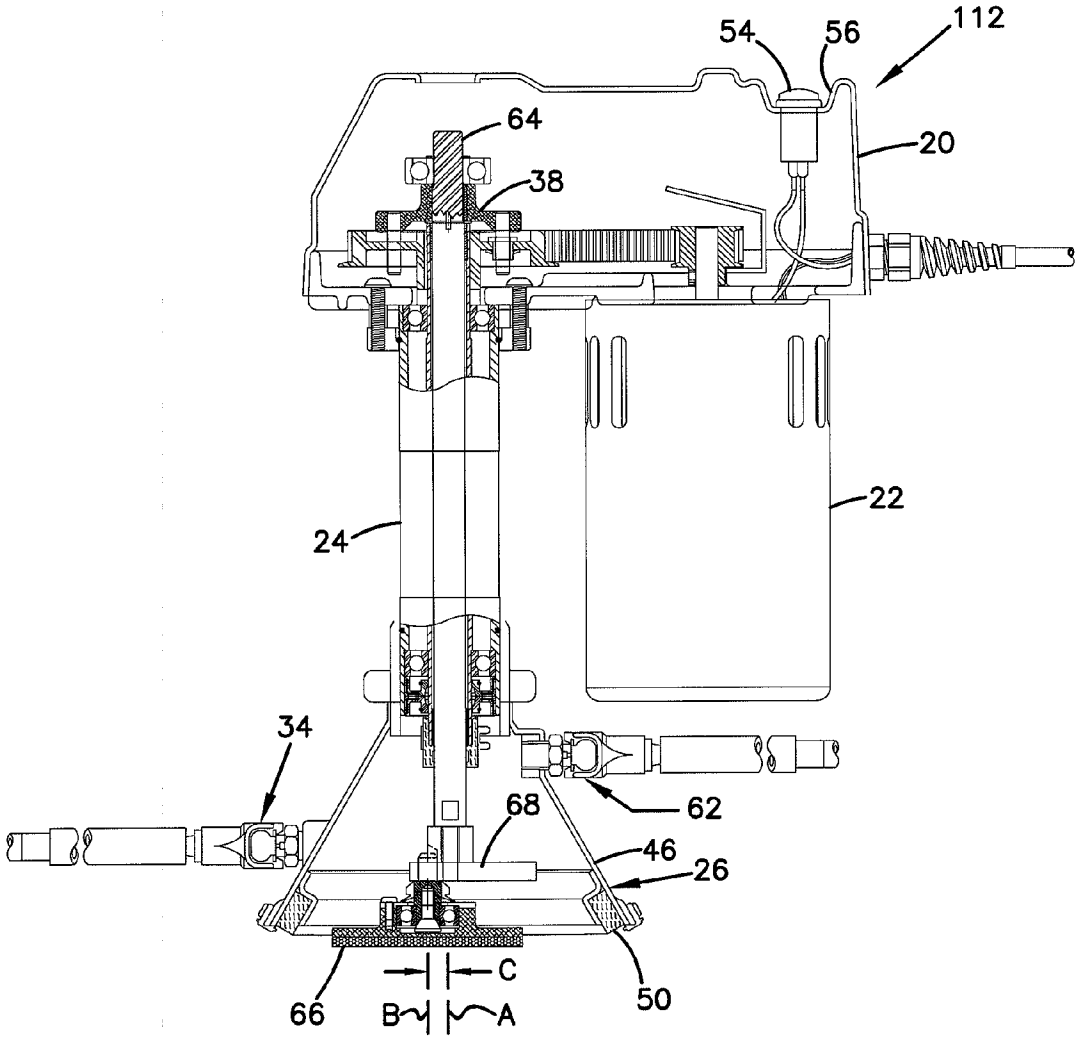
FIG. 7 is a cross-sectional side view of an alternative scratch removal tool configured as a finer tool having an orbital shaft.

The housing 20 includes an On/Off switch 54, a recess 56 within which the switch 54 is positioned, and a plurality of LEDs 58 (see FIGS. 3, 5 and 7). The On/Off switch 54 is positioned on a top surface 21 of the housing (see FIG. 5). Alternatively, the On/Off switch 54 can be positioned on other surfaces of the housing 20. Positioning the On/Off switch 54 in the recess 56 helps protect the switch 54 from inadvertent activation by the operator.

The LEDs 58 are visible from the top surface 21 of the housing 20. In this arrangement, nine LEDs are shown arranged linearly and supported on a printed circuit board (PCB) 59 within the housing 20. The LEDs 58 are viewable through a window 61 in the housing top surface 21. The LEDs 58 can be replaced with any visual indicators generally that could be used to communicate information to the operator about operation of the tool 12. Some example visual indicators include dials, gauges, digital displays and other analog and digital visual indicators.

In one example arrangement of the LEDs 58, each LED can represent a different operational feature of the system 10. For example, illumination of one of the LEDs can represent the On/Off status of the tool 12, while another LED can represent the On/Off status of the slurry pumping system 14. Other of the LEDs can represent the rpms of the motor 22, while still further LEDs can represent the amp level of the motor 22. Other LEDs can represent a vacuum pressure condition within the tool 12 or the slurry pumping system 14.

The LEDs 58 can have different colors to communicate further information about the status of these or other operations and features of the system 10. For example, a series of LEDs can be dedicated to illustrating the amp level of the motor 22, wherein at least one green LED indicates safe operation of the motor, at least one yellow LED indicates operation of the motor close to a maximum amp level, and at least one red LED indicates operation of the motor beyond a maximum amp level.

One or more LEDs can be used in combination with different types of visual indicators in other example arrangements. For example, at least one LED can be used to show an On/Off status of one or more features of the system 10 while a digital display can show the amp level of the motor 22.

The LEDs 58 are shown mounted on the PCB 59 adjacent to the top surface 21 of the housing 20. In other arrangements, the LEDs can be positioned at locations within the housing 20 removed from the top surface 21 and a light piping structure used to direct light generated by the LEDs to any exterior surface of the housing 20 where the directed light can be visualized by the operator.

Figure 6:
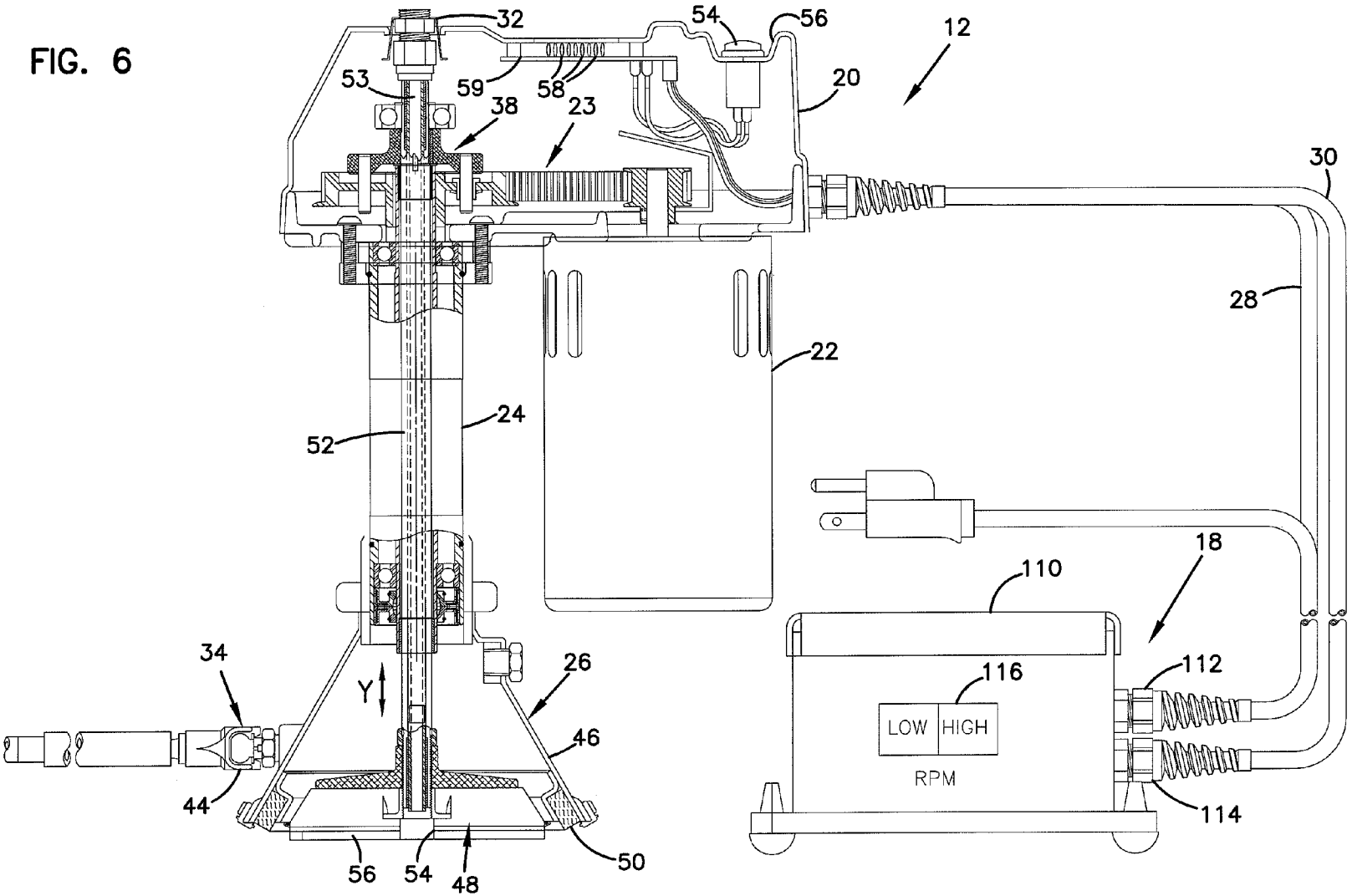
FIG. 6 is a cross-sectional side view of the scratch removal tool and controller shown in FIG. 1 taken along cross-sectional indicators 6-6 in FIG. 4.

The motor 22 provides rotation of the drive shaft 52 via a gear assembly 23 (see FIG. 6). Preferably, the motor 22 provides rotation of the shaft 52 at a relatively high rate in the range of about 4,000 to about 6,000 rpm for a polishing operation. Different rpms for the shaft 52 can be used for a fining operation versus a polishing operation. In one example polishing operation, the motor 22 provides rotation of the shaft 52 at about 4,500 rpms when a load is applied to the pad (i.e., the polishing pad is polishing the surface being worked).

The motor 22 can be a brushless DC motor. Brushless DC motors can maintain a relatively constant rpm for the shaft 52 across a range of loads being applied to the motor (i.e., amps being drawn by the motor) until a threshold load is met. After the threshold level is met, the rpms typically drop off significantly. In one example, the motor 22 is a brushless motor is a 1⅛ HP brushless DC rated at 120 VAC at 1,000 Watts. The motor 22 can be current limited for safe motor controller operation at, for example, a 9 amp maximum. When operating above 9 amps, the rpms will drop off rapidly indicating maximum power has been reached. The motor 22 can maintain a 4,500 rpm rotation of the shaft 52 within the operating range of about 6 to about 9 amps. Above the level of about 9 amps, the rpms of the shaft typically will reduce significantly.

A brushless motor can offer greater efficiency and longevity for the size of motor preferred for the scratch removal tools described herein (e.g., a 3¼ inch diameter by 5 inch long housing). Typically, a brushless motor of this preferred size can produce up to about 60% more torque at a given rpm than alternative universal wound motors. The brushless motor can have a life of up to about 10,000 hours of operation as compared to about 500 hours of operating life for the alternative universal wound motor.

The controller 18 helps control operation of the motor 22. For example, the controller 18 can monitor and control, for example, the power being supplied, the load applied to the motor, the rpms of the motor, and other aspects of the motor operation, and then provide automated control of the motor 22. The controller can help maintain a predetermined rpms of the motor through a range of power (e.g., amps) being drawn by the motor (i.e., through a range of loads applied to the motor).

The controller 18 can include a plurality of settings manually set by the operator. For example, the controller 18 can be activated in a low rpm setting wherein a predetermined rpm is maintained by the motor 22 over a range of amps. Likewise, a high rpm setting can be manually set at the controller 18 to provide a higher rpm for the motor 22 over a given range of amps, or a variable setting for manually adjusting the rpms of the motor to any desired level. Such high and low settings can correspond to fining versus polishing operations for the system 10. Visual indicators on the tool 12 (e.g., LEDs 58) can visually indicate an rpm setting of the controller 18. Other settings for the controller 18 can be possible such as, for example, the range of amps for each rpm setting (i.e., lower and upper threshold load settings to be applied for safe operation of the motor 22 for a given rpm setting).

The controller 18 can includes a number of components that are not illustrated. For example, the controller 18 can include a power PC board and a controller board. The power board converts a 120 VAC input to an appropriate DC voltage for operation of the motor. The controller board can function like a central processing unit that controls the motor rpm, voltage, amperage at the programmed levels. In one arrangement, the controller 18 controls the motor 22 using Hall elements placed inside the motor on the field windings that sense a position and rpm of the motor 22 and sends the signals back to the controller 18 where any adjustments are made to maintain a given rpm, to stop or start the motor, or to change or limit the rpm of the motor.

The shaft housing 24 interconnects the housing 20 and the head 26. In some arrangement, the shaft housing 24 can be integral with the housing 20. In other arrangements, the shaft housing 24 can be a separate piece from the housing 20. In other arrangements, the shaft housing 24 can be integral with the head 26. Alternatively, the head 26, or at least portions of the head 26 can be removably coupled to the shaft housing 24. The assembly of the housing 20, shaft housing 24, and head 26 provide an enclosure within which the shaft 52, gear assembly 23 and some of the electronics (e.g., LEDs 58) can be positioned. Various portions of the internal cavities defined by the housing 20, shaft housing 24 and head 26 can be fluid or air sealed from each other to reduce the possibility of contamination and hazard.

The head 26 includes a shroud 46, a pad 48, and an edge seal 50 (see FIG. 6). The shroud 46 has a generally conical shape. In other arrangements, the shroud 46 can have different shapes and sizes. The conical shape of the shroud 46 helps direct the slurry toward the surface 2 that is being treated.

The pad 48 includes a center opening 54, a plurality of fluid channels 56, and a plurality of additional recesses 57. The center opening 54 is coupled in fluid communication with the bore 53 of the shaft 52. The fluid channels 56 and recesses 57 are defined in a polishing surface 49 of the pad 48 that faces the surface 2 that is being treated. In operation, slurry is provided through the core 53 of the shaft 52 via the slurry input connector 32, and through the center opening 54 of the pad to the polishing surface 49 of the pad. Centrifugal force is provided by rotation of the pad 48 to force the slurry along the fluid channels 56 in a radially outward direction. Various configurations of the pad are described in at least U.S. Pat. No. 7,137,872 and published patent application US 2007/0077864.

The edge seal 50 is provided around a periphery edge of the shroud 46. The edge seal 50 helps contain the slurry within the shroud 46 during operation. The edge seal 50 is most effective in helping retain the slurry when a vacuum condition exists within the shroud 46, thereby providing a fluid tight seal between the shroud 46 and the surface 2. When the vacuum pressure condition within the shroud is released via, for example, the vacuum release member 42, it becomes more difficult to retain the slurry within the shroud 46. The edge seal 50 comprises a material that, when lubricated by lubricant supplied via lubricant nozzle 36, will slide across surface 2 in the direction X while maintaining the vacuum pressure condition within the shroud 46 during operation of the scratch removal tool 12.

The slurry input connector 32 is positioned at the top surface 21 of the housing 20. The connector 32 can include a quick connect disconnect connector 40. A vacuum release member 42 can also be positioned at the connector 32. The slurry input connector 32 provides flow communication to any slurry pumping system 14 and the internal bore 53 of the drive shaft 52 (see FIG. 6).

Positioning the vacuum release member 42 on the top of the tool 12 can provide easier access to the release member 42 by the operator. The configuration and positioning of the release member 42 can also be more reliable because it is less likely to get bumped open or leak. When the vacuum release valve 42 is actuated, it stops any further slurry from entering the tool 12, because the vacuum no longer is acting on the slurry held in the tool 12. The release of the vacuum allows the slurry output connector 34 on the shroud 46 to aspirate the remaining slurry in the shroud 46 back to the slurry pumping system.

The slurry output connector 34 is positioned on the shroud 46 of the head 26. The output connector 34 is coupled to a return line of the slurry pumping system 14. The output connector 34 is in flow communication with a supply of slurry positioned within the head 26 that has been used during the polishing or fining process. The output connector 34 can also include a quick connect/disconnect connector 44 to aid in releasable connection with the return line of the slurry pumping system 14.

The lubricant nozzle 36 is typically coupled to a supply of liquid lubricant (not shown). The operator can feed the supply of lubricant through the lubricant nozzle 36 onto the surface 2 being treated by the scratch removal tool 12. The lubricant supplied by the lubricant nozzle 36 promotes easier movement of the tool 12 along the surface 2 in the direction X (see FIG. 1). An example lubricant is sold under the name of GLASS GLEAM™, a product marketed by Titan Laboratories of Denver, Colo. Preferably, the lubricant used is compatible with the slurry so as not to affect the performance of the slurry that is being circulated through the system 10.

Control of the flow of the lubricant from the lubricant nozzle can vary depending on the needs of the system. In one example, an On/Off switch for the lubricant is provided remote from the scratch removal tool 12. Further, the lubricant can be supplied to the lubricant nozzle 36 at all times. The scratch removal tool 12 is turned on via the On/Off switch 54. The lubricant nozzle 36 has an output opening that is preferably positioned directly adjacent to the surface 2. However, in other arrangements the output opening of the lubricant nozzle 36 can be positioned spaced further from the surface 2. For example, the lubricant nozzle 36 can be mounted to the shaft housing 24 so as to be spaced further from the surface 2.

The actuator assembly 38 can include a lever 39 (see FIG. 1) and a shaft bracket 41 (see FIG. 6). Actuation of the actuator assembly 38 moves the shaft 52 in the direction Y (see FIG. 6) to engage and disengage the polishing or fining pad with the surface 2. The actuator assembly 38 can be adapted to maintain a given position relative to the surface 2 until manually released or otherwise moved from that position.

The Slurry Pumping System

Figure 2:
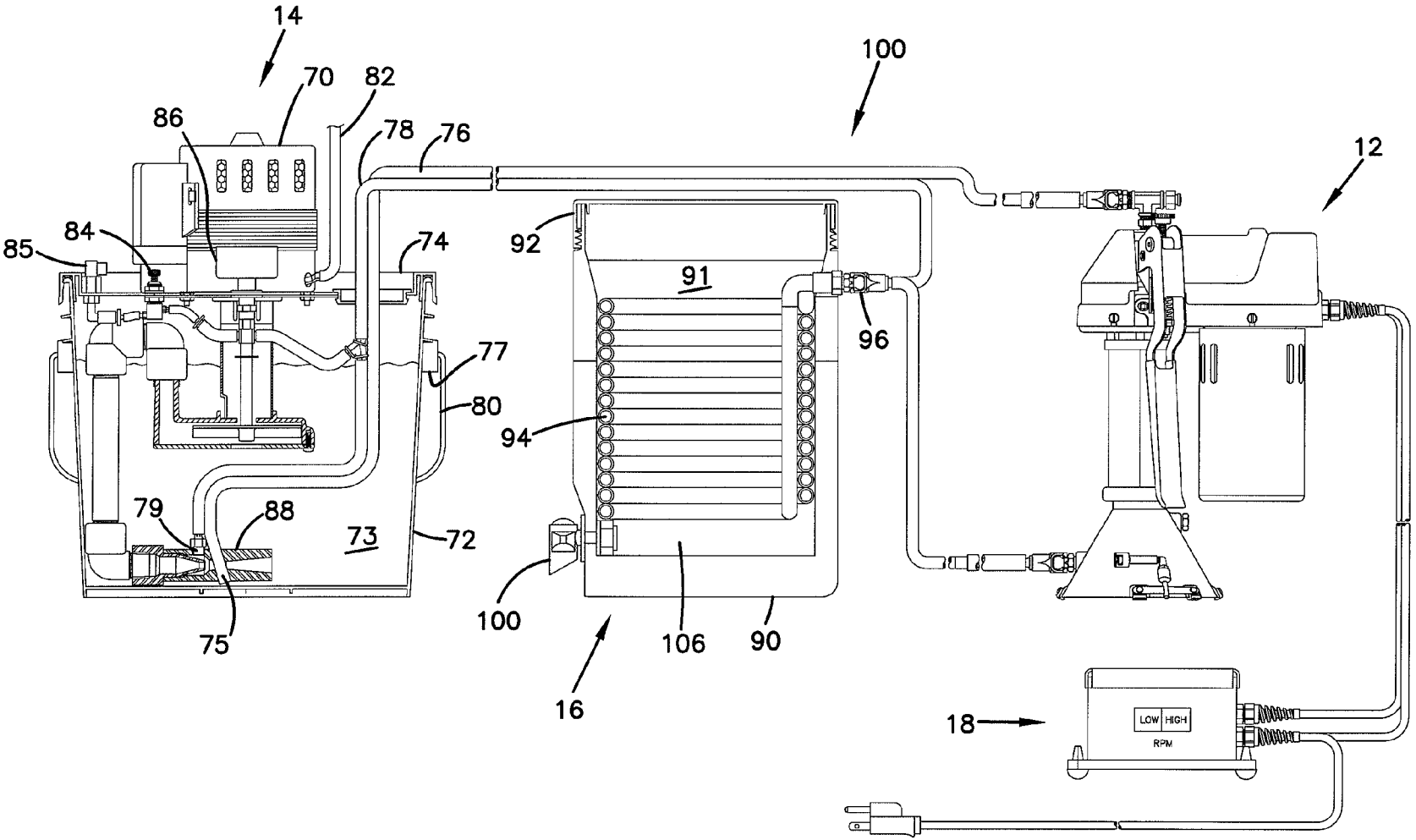
FIG. 2 is a partial cross-sectional side view of the scratch removal system shown in FIG. 1.

Referring to FIGS. 1-3, the slurry pumping system 14 includes a pump 70, a housing body 72, a housing lid 74, feed and return lines 76, 78, a handle 80, a power supply 82, a pressure regulator 84, a meter 86, and a mixing member 88.

A feed line 76 has an open inlet and positioned within the reservoir 73 in fluid communication with the supply of slurry 77 (see FIG. 2) held in the reservoir 73. The feed line 76 is also in flow communication with the pump 70, wherein the pump 70 provides a force that draws the slurry through an open end 75 of the feed line 76 to the scratch removal tool 12. A return line 78 extends from the scratch removal tool 12 to an open end 79 of the return line 78 that is positioned within the reservoir 73. The return line 78 is also in flow communication with an aspirator 88 that is positioned adjacent a bottom surface of the reservoir 73. The aspirator 88 helps generate the vacuum pressure condition in the system 10. In one example, the aspirator generates a vacuum condition of about 25 inches of Mercury, with the vacuum pressure condition available to the scratch removal tool is about 15 inches of Mercury when taking into account system pressure losses. The aspirator 88 also provides mixing of the slurry supply by agitating the slurry to maintain solids in the slurry supply 77 in suspension. The pump 70 thus provides a vacuum force for moving the slurry to and from the scratch removal tool 12, and also agitates the slurry in the reservoir 73.

A handle 80 can be mounted to the housing body 70 to provide easier transportation of the slurry pumping system 14. A power supply 82 is coupled to the pump 70 to power the pump 70 independent of operation of the scratch removal tool 12. A vacuum regulator 84 can be used to help regulate the vacuum pressure applied by the pump 70. The vacuum regulator 84 can be any analog, digital, manual or electronic device. The vacuum regulator 84 is coupled in air flow communication with a vacuum bleed 85 that is open to atmosphere outside of the reservoir 73. The slurry pumping system 14 can further include a meter 86. The meter 86 can provide feedback to the operator related to, for example, the vacuum pressure condition in one or both of the feed and return lines 76, 78, indicate a level of the slurry supply in the reservoir 73, or indicate a pressure condition within the reservoir 73 itself. Multiple meters 86 can be used as necessary to monitor and provide feedback of various features and functions of the slurry pumping system 14.

The pump 70 can be an air cooled pump. In one example, the pump 70 provides a vacuum pressure of about 25 to about 27 inches of Mercury when there feed and return lines 76, 78 are sealed closed. In operation, the pressure regulator 84 can be adjusted to the desired setting of about 10 inch of Mercury for polishing and abut 7 inches of Mercury for fining. Positioning the pump 70 outside of the reservoir 73 physically separated from the supply of slurry 77 makes it possible to transfer any heat generated by the pump 70 to the environment surrounding the slurry pumping system 14 rather than to the supply of slurry 77 itself. This physical separation of the pump 70 from the slurry supply helps maintain a lower operating temperature for the slurry supply. Positioning the pump 70 outside of the reservoir 73 also permits the use of a larger sized, greater horsepower, and possibly more efficient pump than those pumps that could be used within the reservoir 73. The importance of maintaining a certain operating temperature of the slurry supply is discussed in further detail below.

The slurry pumping system 14 can be configured with no moving parts within the reservoir 73. The flow of the slurry supply 77 into and out of the reservoir 73 can provide the desired agitation of the slurry supply 77. Avoiding moving parts in the reservoir 73 can help avoid the additional of further heat into the supply of slurry 77.

The Slurry Chiller System

A slurry chiller system 16 can be used in the scratch removal system 10 to maintain the slurry supply provided to the scratch removal tool 12 below a predetermined temperature. The slurry chiller system 16 is shown operatively coupled in the return line 78 of the slurry pumping system 14. The slurry chiller system 16 includes a housing body 90 and a housing lid 92 that together define a reservoir 91. A coil 94 is positioned within the reservoir 91. An inlet connector 96 and outlet connector 98 (see FIG. 1) are coupled to opposing inlet and outlet ends of the coil 94. With this configuration, heated slurry leaving the scratch removal tool 12 via the slurry output connector 34 passes through the coil, which is positioned within the reservoir 91 and then out of the slurry chiller system 16 via the outlet connector 98.

While the heated slurry is within the coil 94, the slurry can be cooled if the coil 94 has a temperature less than the temperature of the slurry. The coil 94 can be cooled by removing heat from the coils via convection or conduction. In a convection cooling arrangement (not shown) a flow of cooled air (i.e., air having a temperature less than the temperature of the heated slurry passing through the coil 94) is moved across the outer surfaces of the coil 94. In a conduction cooling system, the outer surfaces of the coils 94 are brought in contact with a liquid or solid that has a temperature less than the temperature of the heated slurry.

FIG. 2 illustrates the reservoir 91 filled with a cooling material 106 such as, for example, ice, an ice and water mixture, or other liquid and solid particles that are at a low temperature state. In the case of using ice as the cooling material 106, the ice tends to cool the coil 94, thereby cooling the heated slurry that passes within the coil 94. Thus, slurry exiting the slurry chiller system 16 via the outlet connector 98 has a lower temperature than the slurry entering the chiller system 16 via the inlet connector 96.

The slurry chiller system 16 is operable to reduce the operating temperature of the slurry without the use of any mechanical or electrical parts. The method of cooling the slurry using the slurry chiller system 16 can be defined as a passive cooling system in that no external power source or power requirement is needed in order to provide the desired heat exchange. After the cooling material 106 has been reduced to a liquid form, the cooling material 106 can be removed from the reservoir 91 via a drain 100. Alternatively, the housing lid 92 can be removed and the cooling material 106 dumped out of the housing body 90 via the open top end.

The slurry chiller system 16 can include a bypass structure 102 (see FIG. 1). The bypass 102 can be manually or automatically actuated to bypass the coil 94. In one example, the bypass (or thermo switch) 102 operates as a thermo activated switch. When the temperature of the slurry entering via the connector 96 is above a predetermined temperature (e.g., about 95 to 100 degrees F.) the switch remains open so that the slurry can pass through the coil and back out of the outlet connector 98. When the thermo switch 102 detects a temperature of the incoming slurry the connector 96 below the predetermined temperature, the thermo switch 102 closes, thereby bypassing the coil and channeling the slurry directly to the outlet connector 98.

The thermo switch 102 can alternatively include a thermostat (not shown) that can be monitored by the operator and the thermo switch manually activated to provide bypass of the coil 94. In still further arrangements, the bypass 102 may merely include a bypass valve that is manually activated by the operator at any given time as determined by other parameters (e.g., a temperature of the slurry supply held in reservoir 73 of the slurry pumping system 14, or a temperature reading of the slurry at the slurry input or slurry output 32, 34, respectively of the scratch removal tool 12.

The housing body 90 and housing lid 92 of the slurry chiller system 16 can include insulated material that helps maintain the temperature of the cooling material 106. In one example, the housing body 90 and housing lid 92 are defined by a one to five gallon thermos-type or water cooler-type structure having insulated side walls. Such a pre-formed product with a removable lid could be easily modified to include opening through which the input and output ends of the coil 94 can extend for positioning of the coil 94 within the reservoir 91.

Maintaining the slurry supply provided to the scratch removal tool 12 within a predetermined range of temperatures (e.g., about 80 to about 95 degrees F.) can have advantages related to performance of the scratch removal tool 12 in removing scratches or other deformations on the surface 2 to the polish. Likewise, a slurry supply having a temperature below a predetermined level (e.g., below 80 degrees F.) can affect the performance of the scratch removal tool 12.

While the above description directed to the slurry chiller system 16 emphasizes maintaining the slurry supply below a predetermined temperature, other configurations may be possible to increase the operating temperature of the slurry supply if the slurry supply has a temperature below a predetermined level. In one example configuration, the reservoir 91 of the slurry chiller system 16 can be filled with a heated material (e.g., hot water or a heated gel) that is used to increase the temperature of the slurry supply. In one scenario, when the scratch removal system 10 is being used in cold ambient conditions (e.g., less than 50 degrees F. or colder) the slurry supply held in the reservoir 73 of the slurry pumping system 14 may be well below the lowest preferred operating temperature for the slurry supply for the initial operation of the system 10 (e.g., for the first 5 to 30 minutes of use of the system 10). In such a scenario, it may be helpful to initially heat the slurry supply using a heated material in the reservoir 91.

The bypass 102 could be configured to change from heating the slurry supply using the slurry chiller system 16, to a configuration in which the slurry chiller system 16 is bypassed. The thermo switch described above could be set for a predetermined minimum temperature (e.g., less than 70 or 80 degrees F.) of the slurry supply supplied at the connector 96 as well as a maximum threshold temperature condition (e.g., 95 to 100 degrees F.). Many other ranges of preferred operating temperatures for the slurry supply, including maximum and minimum temperatures, are possible depending on other aspects of the system 10. One example operating temperature range is about 80 to about 95 degrees F.

The coil 94 of the slurry chiller system 16 can have many different constructions. In one example the coil 94 includes at least one 360° rotation within the reservoir 91. In other example, the coil 94 includes a serpentine shaped portion (not shown) or other shaped portions besides the coil shape illustrated. Portions of the coil 94 can be embedded in walls of the housing body 90. The coil 94 can be permanently mounted to the housing body 90 or be removably mounted relative to the housing body 90. The coil 94 can be constructed of an elongate tube having a circular cross-section. Alternatively, the coil 94 can have other constructions and cross-sectional shapes.

The coil defines a fluid path along which the supply of slurry travels. The length of this fluid path can significantly increase the total fluid path defined between the slurry pumping system 14 and the scratch removal tool 12, which is otherwise primarily defined by the feed and return lines 76, 78. This increased fluid path length typically tends to increase the total amount of time required for the vacuum pressure provided by the slurry pumping system 14 to stabilize in the system 10 after creation of a vacuum seal around the edge seal 50 of the shroud 46. One potential benefit of increasing the fluid path length is that it becomes more difficult to lose the vacuum pressure condition in the system 10 if the vacuum seal around the edge seal 50 of the shroud 46 is inadvertently momentarily broken.

Figure 10:
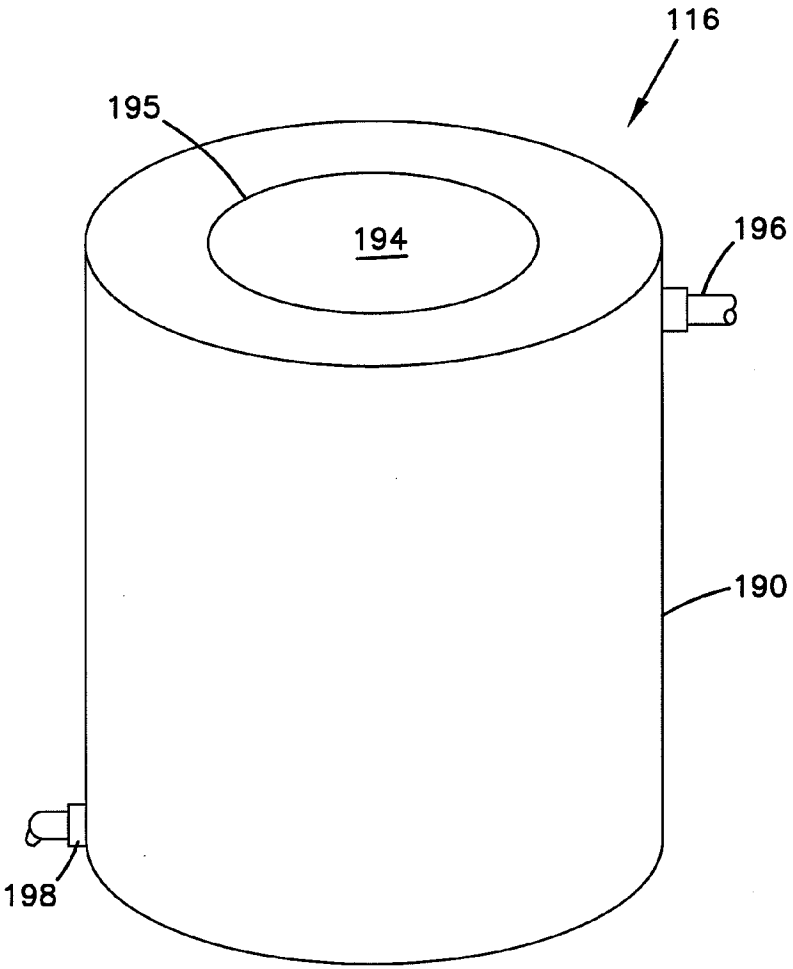
FIG. 10 is a perspective view of another example slurry chiller system in accordance with the present disclosure.
Figure 11:
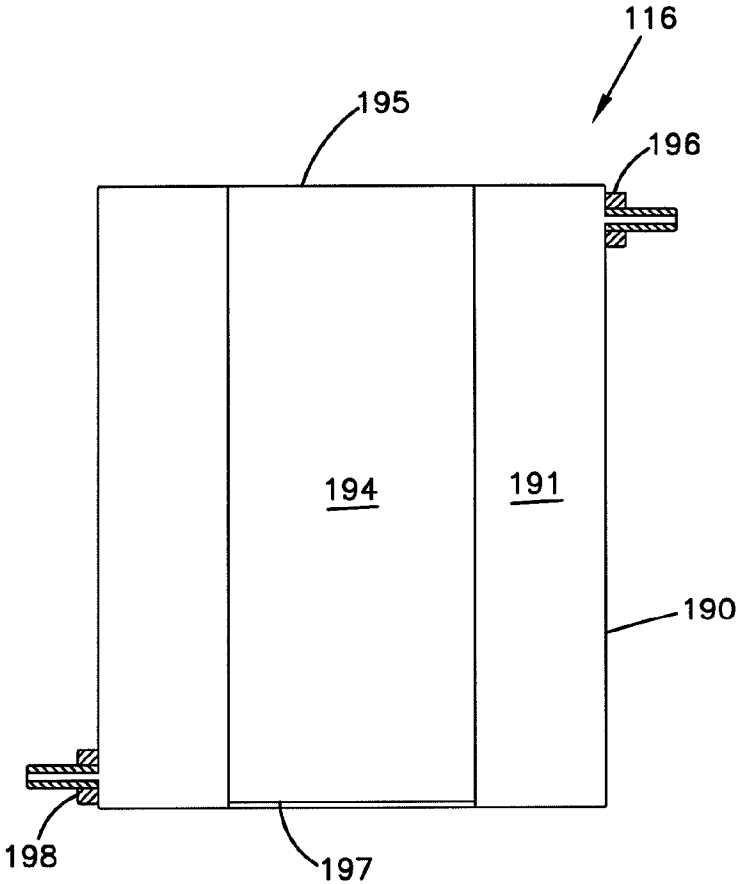
FIG. 11 is a cross-sectional side view of the slurry chiller system shown in FIG. 10.

An alternative construction for a slurry chiller system 116 is shown with reference to FIGS. 10-11. The slurry chiller system 116 includes a housing body 190 defining a reservoir 191. The housing body 190 defines a hollow core 194 having an open upper end 195 and a closed lower end 197. An inlet connector 196 is positioned at an upper end along one side of the housing 190, and an outlet connector 198 is positioned at a lower end along an opposing side of the housing 190. A cooling material (not shown) can be held within the hollow core 194 to cool the housing body 190. A supply of slurry passing through the reservoir 191 is cooled by the housing 190 as slurry travels from the inlet 196 to the outlet 198. The slurry chiller system 116 can include a handle, a lid, baffle members within the reservoir 191 (none of which are shown) and other features that promote heat transfer, usability, transportability and other characteristics of the slurry chiller system 116.

The slurry chiller systems 16, 116 do not require an external power source or any moving parts. A slurry chilling system that does not require an external power source or any moving parts can have advantages related to durability, low operation costs, easy portability, and simplified operation and use. In an configuration in which a thermo switch or valve is used with the slurry chiller system, such a switch can be configured to operate using battery power, thus eliminating the need for further AC power cords in the system 10. Alternatively, AC power can be provided from the scratch removal tool 12, 112, the slurry pumping system 14, the controller 18, or another power source.

Figure 9:
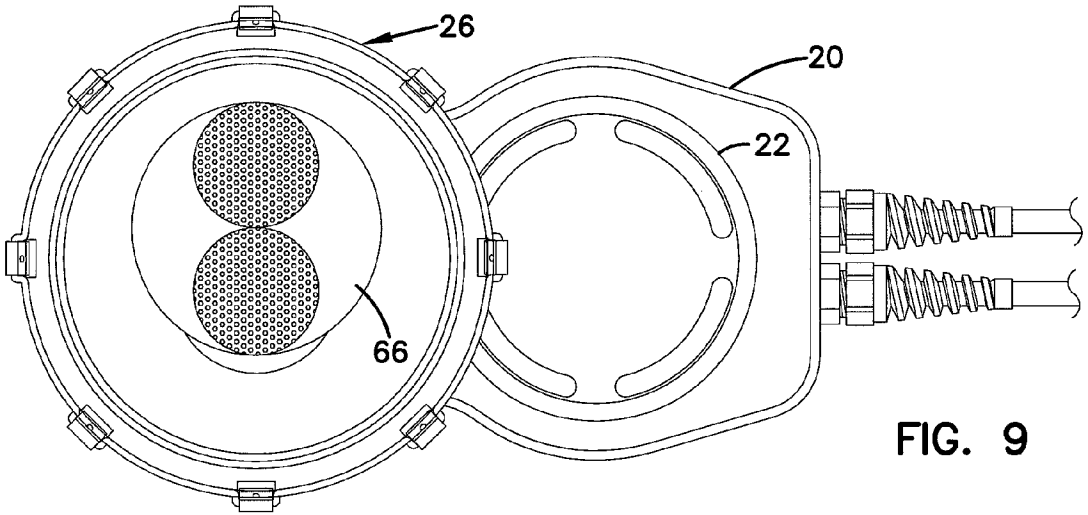
FIG. 9 is bottom plan view of portions of the scratch removal tool shown in FIG. 7.
Figure 8:
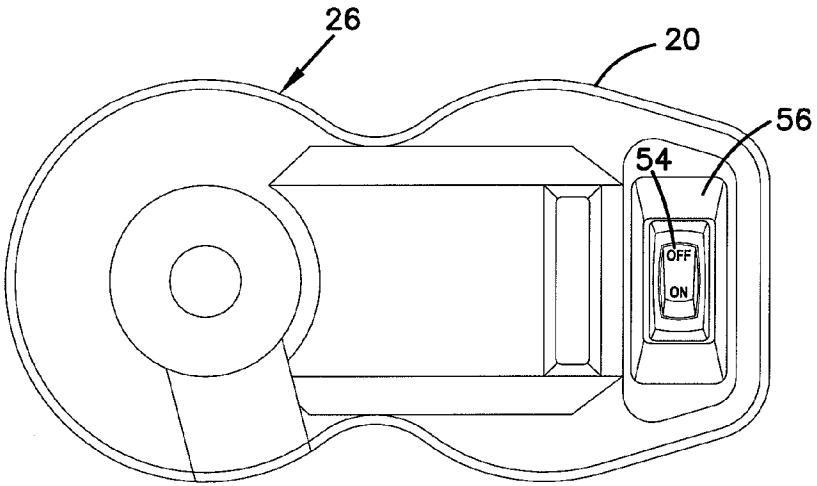
FIG. 8 is a top plan view of portions of the scratch removal tool shown in FIG. 7.

Fining Scratch Removal System of FIGS. 7-9

FIGS. 7-9 illustrate a scratch removal system 100 wherein the scratch removal tool 112 is configured as a fining scratch removal tool. The scratch removal tool 112 includes many of the same or similar features as described above with reference to FIGS. 1-6. The finer scratch removal tool 112 includes an orbital shaft 64 having an orbital bracket 68 mounted thereto. A fining pad 66 is mounted to the orbital bracket 68. The orbital shaft 64 rotates about a shaft axis A, and the fining pad 66 rotates about a pad axis B that is offset a distance C from the shaft axis A. The distance C can vary as the fining pad 66 rotates about the shaft axis A. The resulting orbital motion of the fining pad 66 is different from the coaxial rotation motion of the pad 48 and shaft 52 of the polishing scratch removal tool 12 described above. Aspects of a finer scratch removal tool having an orbital shaft and fining pad are described with reference to U.S. Pat. Nos. 4,709,513 and 4,622,780 mentioned above.

The finer scratch removal tool 112 further includes a slurry inlet connector 62 positioned on the shroud 46 and an outlet slurry connector 34 also positioned on the shroud 46. A fining operation does not require a center feed for the slurry through the fining pad 66. For a fining process, it is sufficient to provide a supply of slurry within the shroud 46 that engages at least a portion of the fining pad 66 during its orbital path of motion. While the use of a drive shaft having a hollow central bore through which a slurry supply is fed (e.g., shaft 52) is not required for the fining scratch removal tool 112, such a shaft and type of slurry supply could still be used with the finer scratch removal tool 112.

The use of a common hollow core shaft for the fining and polishing tools shown in FIGS. 1-9 could provide the use of the same tool 12 for both fining and polishing operations by merely changing the type of polishing pad and pad mounting for a given operation.

The shroud 46 used for the scratch removal tools 12, 112 shown in FIGS. 6 and 7 can have the same shape, size and sealing features. Further, the drive shaft used for both of the scratch removal tools 12, 112 can be the same such that replacement of the pad 48, 66 could be performed in combination with or without changing the slurry input connector from the top end of the tool 12 (see FIG. 6) to the shroud (see FIG. 7) to change the scratch removal tool from a polishing tool to a fining tool. A quick release or other type of bracket or connector could be used to exchange the pads 48, 66 with each other.

A vacuum release valve (not shown in FIGS. 7-9) could be mounted to the shroud 46 adjacent the inlet connector 96 using, for example, a T-fitting. One side of the T-fitting would mount the connector 96 while the opposite side of the T-fitting would mount the vacuum release member.

The finer scratch removal tool 112 is shown without the LEDs 58 shown with reference to tool 12. Some fining operations do not require significant torque, and thus require a relatively low and stable amp requirement. Therefore, providing a visual indication of the amp level of the motor 22 to the operator to ensure the maximum safe operating amp level is not exceeded can be less important for a fining operation than for a polishing operation. However, the finer scratch removal tool 112 can include visual indicators, such as LEDs, that provide a visual indication of other functions of the tool 112 such as the functions and indicators described above with reference to tool 12 and LEDs 58.

Conclusion and Other Considerations

The scratch removal tools 12, 112 described herein for use in polishing and fining operations can be used with pads and slurries that include or are void of abrasive materials. In one example polishing arrangement, an abrasive filled pad is used in combination with an abrasive slurry, wherein the concentration of abrasive in the pad and slurry are optimized for polishing whatever material that defines the surface being polished. One example abrasive material is Cerium Oxide. An example polishing slurry includes a concentration of Cerium Oxide to water of about 5 ounces per gallon. In an example fining operation, about 11½ ounces of Cerium Oxide are used per gallon of water in combination with a abrasive pad.

In other arrangements, different combinations of abrasive materials can be used. For example, an abrasive pad (i.e., a fixed abrasive) can be used with a non-abrasive slurry (e.g., water), or a non-abrasive (lapping) pad can be used with an abrasive slurry (i.e., loose abrasive). The term "slurry" as used herein can comprise only a liquid base such as water, or a mixture of the liquid base and a non-soluble substances (e.g., loose abrasive particles). While the term "slurry" is used to describe the pumping system 14, the chiller system 16, and other aspects of the system 10, the use of this term should not preclude the use of a liquid base such as water without a non-soluble substance in any part or function of the system 10.

The Cerium Oxide used in the pad and slurry can have different purity and particle size, both characteristics of which can affect the performance of the Cerium Oxide in leave the glass with an acceptable sheen. In one example, a 17 micron particle size is used in the slurry for a pre-fining operation that treats deep scratches, and a 5 micron particle size is used in the slurry of for a regular fining operation. Using at least two different fining processes, wherein each process uses a different abrasive particle size can decrease the overall amount of time required for a fining operation. In one example, using a two-step fining process using the 17 micron and 5 micron particle sizes noted above decreased the overall time for the fining operation by about 40% as compared to a single step process in which a 9 micron particle size was used.

One aspect of the present disclosure relates to a scratch removal system that includes a scratch removal tool, a slurry pumping system, a controller, and a slurry cooling system. The scratch removal tool includes a motor, a housing, a rotatable shaft, and a head assembly. The rotatable shaft is operably coupled to the motor and movable in an axial direction along a length of the shaft. The head assembly includes a shroud member having an open end, and a polishing pad member positioned within the shroud and mounted to the shaft. Rotation of the shaft rotates the pad member and axial movement of the shaft moves the pad member relative to the open end of the shroud. The slurry pumping system includes a pump, a slurry reservoir configured to retain a supply of slurry, a slurry feed line and a slurry return line. The slurry feed line is in fluid communication with a slurry input of the scratch removal tool. The slurry return line is in fluid communication with a slurry output of the scratch removal tool. The slurry cooling system is coupled in fluid communication with the at least one of the slurry input line or slurry output line to alter a temperature of the supply of slurry. The controller is configured to control at least some operations of the scratch removal tool.

Another aspect of the present disclosure relates to a slurry cooling system that includes an insulated housing member and a slurry carrying member. The insulated housing member defines a cavity, wherein the cavity is adapted to retain a volume of cooling material. The slurry carrying member includes a coil section, an inlet end, and an outlet end. The coil section is positioned in the cavity in engagement with the cooling material. An inlet end and an outlet end of the coil section are positioned outside of the cavity and accessible from an exterior of the housing member. An interior lumen defined by the slurry carrying member is configured to retain a volume of slurry.

A further aspect of the present disclosure relates to a scratch removal tool that includes a motor, a housing, a rotatable shaft operably coupled to the motor and movable in an axial direction along a length of the shaft, and a head assembly. The head assembly includes a shroud member having an open end, a pad member, a slurry input, a slurry output, and a seal member. The pad member is positioned within the shroud and mounted to the shaft. Rotation of the shaft rotates the pad member. Axial movement of the shaft moves the pad member relative to the open end of the shroud. The slurry input and slurry are in fluid communication with the pad member. The seal member is positioned at the open end of the shroud. The motor can be a DC brushless motor operable in the range of 4000 to about 5000 rpm, inclusive, when drawing power in the range of 6 to 9 Amps, inclusive.

A still further aspect of the present disclosure relates to a slurry pumping system that includes a housing member, a housing lid, a pump, a slurry input line, a slurry output line, and a control assembly. The housing member defines a cavity and includes an access opening. The cavity is adapted to retain a volume of slurry. The housing lid is removably mounted to the housing member and configured to seal closed the access opening. The pump is mounted to the housing lid and positioned outside of the cavity. The slurry input line has an open end in fluid communication with the volume of slurry. The slurry output line has an open end in fluid communication with the volume of slurry. The control assembly is configured to control operation of the pump thereby controlling a pressure condition in the slurry output line.

Another aspect of the present disclosure relates to a method of polishing a surface using a scratch removal system. The scratch removal system includes a scratch removal tool and a slurry pumping system. The scratch removal tool includes a housing, a shroud, a motor, and an pad member. The method includes the steps of providing a source of slurry to the scratch removal tool with the slurry pumping system, forming a seal between the shroud and the surface to be polished, and passing the slurry through the scratch removal tool and into engagement with the abrasive member. The method can further include rotating the abrasive member within the shroud using the motor, engaging the rotating abrasive member with the surface to be polished while maintaining the seal between the shroud and the surface to be polished to polish the surface, and providing a visual indicator of an amount of power being used by the motor. The scratch removal system can further includes a slurry cooling system, wherein the slurry cooling system includes a housing that defines a cavity, a cooling material positioned in the cavity, and a slurry carrying member that defines a slurry lumen. A portion of the slurry carrying member can be positioned in the cavity and in engagement with the cooling material. The method can further include passing slurry through the slurry lumen to alter a temperature of the slurry provided to the scratch removal tool.

A further aspect of the present disclosure relates to a method of polishing a surface using a scratch removal system. The scratch removal system includes a scratch removal tool and a source of slurry. The scratch removal tool includes a housing, a shroud, a motor, and a plurality of pad members. The method includes mounting a first of the plurality of pad members to the scratch removal tool, passing the slurry through the scratch removal tool and into engagement with the first pad member, rotating the first pad member within the shroud using the motor, and engaging the rotating first pad member with the surface to be polished to polish the surface. The method further includes replacing the first pad member with a second of the plurality of pad members, passing the slurry through the scratch removal tool and into engagement with the second abrasive member, rotating the second abrasive member within the shroud using the motor, and engaging the rotating second abrasive member with the surface to be polished to further polish the surface.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A scratch removal tool, comprising:

(a) a motor;

(b) a housing;

(c) a rotatable shaft operably coupled to the motor and movable in an axial direction along a length of the shaft, wherein the shaft is hollow and configured to pass a fluid therethrough; and (d) a head assembly, including:

i. a shroud member having an open end;

ii. a pad member positioned within the shroud and mounted to the shaft, wherein rotation of the shaft rotates the pad member and axial movement of the shaft moves the pad member relative to the open end of the shroud;

iii. a slurry input in fluid communication with the pad member;

iv. a slurry output in fluid communication with the pad member; and v. a seal member positioned at the open end of the shroud;

(e) wherein the slurry input is positioned on the housing at an end of the tool opposite the open end of the shroud, the slurry output is positioned on the shroud, and a vacuum release member is positioned at the slurry input, wherein the rotatable shaft is housed in a shaft housing and the motor is positioned in a housing positioned parallel to the shaft housing, and further comprising an actuation lever parallel to the shaft housing, wherein the slurry input and the vacuum release member are positioned at the top surface of the housing.

2. The scratch removal tool of claim 1, wherein the motor is a DC brushless motor operable in the range of about 4000 rpm to about 5000 rpm, inclusive, and power requirements in the range of about 6 amps to about 9 amps, inclusive.

3. The scratch removal tool of claim 1, further comprising a visual indicator of at least one of the motor rpm level and a power level of the motor.

4. A slurry cooling system adapted for use with a scratch removal device, comprising:

(a) an insulated housing member that defines a cavity, the cavity adapted to retain a volume of cooling material, wherein the exterior of the housing member has a cylindrical shape and at least a portion of the cavity has a cylindrical shape; and (b) a slurry carrying member having a coil section having a cylindrically shaped portion positioned in the at least a portion of the cavity having the cylindrical shape, an inlet end, and an outlet end, at least a portion of the coil section being positioned in the cavity in engagement with the cooling material, and the inlet and outlet ends being positioned outside of the cavity and accessible from an exterior of the housing member, and an interior lumen defined by the slurry carrying member being configured to retain a volume of slurry.

5. The slurry cooling system of claim 4, further comprising a thermo switch, the thermo switch being configured to monitor a temperature of the slurry entering the inlet and create a bypass of the coil section if the slurry temperature is outside a predetermined range of temperatures.

6. The slurry cooling system of claim 5, wherein the predetermined range of temperatures is about 80° F. to about 95° F., inclusive.

7. A slurry pumping system, comprising:

(a) a housing member that defines a cavity and an access opening, the cavity being adapted to retain a volume of slurry;

(b) a housing lid removably mounted to the housing member and configured to seal closed the access opening;

(c) a pump mounted to the housing lid and positioned outside of the cavity;

(d) a slurry input line having an open end in fluid communication with the volume of slurry;

(e) a slurry output line having an open end in fluid communication with the volume of slurry; and (f) a control assembly configured to control operation of the pump thereby controlling a pressure condition in the slurry output line.

8. The slurry pumping system of claim 7, further comprising a pressure regulator, the pressure regulator providing pressure condition information to the control assembly.

9. The slurry pumping system of claim 7, further comprising an aspirator, the aspirator being configured to generate a vacuum pressure condition in the housing member cavity.

10. A scratch removal system, comprising:

(a) a scratch removal tool, comprising:

i. a motor;

ii. a housing;

iii. a rotatable shaft operably coupled to the motor, the shaft being movable in an axial direction along a length of the shaft;

iv. a head assembly, comprising:

A. a shroud member having an open end; and

B. a polishing pad member positioned within the shroud member and mounted to the shaft, wherein rotation of the shaft rotates the pad member, and axial movement of the shaft moves the pad member relative to the open end of the shroud;

v. a vacuum release positioned at a top of the housing in an opposite direction to the head assembly;

(b) a slurry pumping system, comprising:

i. a pump;

ii. a slurry reservoir configured to retain a supply of slurry;

iii. a slurry feed line in fluid communication with a slurry input of the scratch removal tool;

iv. a slurry return line in fluid communication with a slurry output of the scratch removal tool;

(c) a slurry cooling system coupled in fluid communication with the at least one of the slurry input line and the slurry output line, the slurry cooling system being configured to alter a temperature of the supply of slurry; and (d) a controller configured to control at least some operations of the scratch removal tool.

11. The scratch removal tool of claim 3, wherein the visual indicator includes a plurality of discrete lights arranged in a row, wherein the plurality of discrete lights include a plurality of different colors.

12. The scratch removal tool of claim 1, wherein the housing includes an on/off switch, wherein the housing defines a recess, wherein the on/off switch is positioned in the recess.

13. The scratch removal tool of claim 1, further comprising a slurry cooling system comprising:

(a) an insulated housing member that defines a cavity, the cavity adapted to retain a volume of cooling material; and (b) a slurry carrying member having a coil section, an inlet end, and an outlet end, at least a portion of the coil section being positioned in the cavity in engagement with the cooling material, and the inlet and outlet ends being positioned outside of the cavity and accessible from an exterior of the housing member, and an interior lumen defined by the slurry carrying member being configured to retain a volume of slurry.

14. The scratch removal tool of claim 13, wherein the exterior of the housing member of the slurry cooling system has a cylindrical shape and at least a portion of the cavity has a cylindrical shape.

15. The scratch removal tool of claim 13, further comprising a thermo switch, the thermo switch being configured to monitor a temperature of the slurry entering the inlet end and create a bypass of the coil section if the slurry temperature is outside a predetermined range of temperatures.

16. The scratch removal tool of claim 15, wherein the predetermined range of temperatures is about 80° F. to about 95° F., inclusive.

17. The scratch removal tool of claim 13, further comprising a slurry pumping system, comprising:

(a) a housing member that defines a cavity and an access opening, the cavity being adapted to retain a volume of slurry;

(b) a housing lid removably mounted to the housing member and configured to seal closed the access opening;

(c) a pump mounted to the housing lid and positioned outside of the cavity;

(d) a slurry input line having an open end in fluid communication with the volume of slurry;

(e) a slurry output line having an open end in fluid communication with the volume of slurry; and (f) a control assembly configured to control operation of the pump thereby controlling a pressure condition in the slurry output line.

18. The scratch removal tool of claim 17, wherein the slurry pumping system further comprises a pressure regulator, the pressure regulator providing pressure condition information to the control assembly.

19. The scratch removal tool of claim 17, wherein the slurry pumping system further comprises an aspirator, the aspirator being configured to generate a vacuum pressure condition in the housing member cavity.

20. A scratch removal tool, comprising:

(a) a motor;

(b) a housing;

(c) a rotatable shaft operably coupled to the motor and movable in an axial direction along a length of the shaft, wherein the shaft is hollow and configured to pass a fluid therethrough; and (d) a head assembly, including:

i. a shroud member having an open end;

ii. a pad member positioned within the shroud and mounted to the shaft, wherein rotation of the shaft rotates the pad member and axial movement of the shaft moves the pad member relative to the open end of the shroud;

iii. a slurry input in fluid communication with the pad member;

iv. a slurry output in fluid communication with the pad member; and v. a seal member positioned at the open end of the shroud;

(e) wherein the slurry input is positioned on the housing at an end of the tool opposite the open end of the shroud, the slurry output is positioned on the shroud, and a vacuum release member is positioned at the slurry input;

(f) a visual indicator of amp level of the motor, wherein the visual indicator includes a plurality of discrete lights arranged in a row, wherein the plurality of discrete lights include a plurality of different colors, wherein one color indicates safe operation of the motor, wherein another color indicates operation of the motor beyond a maximum amp level.

21. A scratch removal tool, comprising:

(a) a motor;

(b) a housing;

(c) a rotatable shaft operably coupled to the motor and movable in an axial direction along a length of the shaft, wherein the shaft is hollow and configured to pass a fluid therethrough; and (d) a head assembly, including:

i. a shroud member having an open end;

ii. a pad member positioned within the shroud and mounted to the shaft, wherein rotation of the shaft rotates the pad member and axial movement of the shaft moves the pad member relative to the open end of the shroud;

iii. a slurry input in fluid communication with the pad member;

iv. a slurry output in fluid communication with the pad member; and v. a seal member positioned at the open end of the shroud;

(e) wherein the slurry input is positioned on the housing at an end of the tool opposite the open end of the shroud, the slurry output is positioned on the shroud, and a vacuum release member is positioned at the slurry input; and further comprising a slurry cooling system including:

(a) an insulated housing member that defines a cavity, the cavity adapted to retain a volume of cooling material, wherein the exterior of the housing member of the slurry cooling system has a cylindrical shape and at least a portion of the cavity has a cylindrical shape; and (b) a slurry carrying member having a coil section having a cylindrically shaped portion positioned in the at least a portion of the cavity having the cylindrical shape, an inlet end, and an outlet end, at least a portion of the coil section being positioned in the cavity in engagement with the cooling material, and the inlet and outlet ends being positioned outside of the cavity and accessible from an exterior of the housing member, and an interior lumen defined by the slurry carrying member being configured to retain a volume of slurry.

22. The scratch removal tool of claim 21, further comprising a thermo switch, the thermo switch being configured to monitor a temperature of the slurry entering the inlet end and create a bypass of the coil section if the slurry temperature is outside a predetermined range of temperatures.

23. The scratch removal tool of claim 22, wherein the predetermined range of temperatures is about 80° F. to about 95° F., inclusive.

24. The scratch removal tool of claim 21, further comprising a slurry pumping system, comprising:

(a) a housing member that defines a cavity and an access opening, the cavity being adapted to retain a volume of slurry;

(b) a housing lid removably mounted to the housing member and configured to seal closed the access opening;

(c) a pump mounted to the housing lid and positioned outside of the cavity;

(d) a slurry input line having an open end in fluid communication with the volume of slurry;

(e) a slurry output line having an open end in fluid communication with the volume of slurry; and (f) a control assembly configured to control operation of the pump thereby controlling a pressure condition in the slurry output line.

25. The scratch removal tool of claim 24, wherein the slurry pumping system further comprises a pressure regulator, the pressure regulator providing pressure condition information to the control assembly.

26. The scratch removal tool of claim 24, wherein the slurry pumping system further comprises an aspirator, the aspirator being configured to generate a vacuum pressure condition in the housing member cavity.

27. A scratch removal tool, comprising:

(a) a motor;

(b) a housing;

(c) a rotatable shaft operably coupled to the motor and movable in an axial direction along a length of the shaft, wherein the shaft is hollow and configured to pass a fluid therethrough; and (d) a head assembly, including:

i. a shroud member having an open end;

ii. a pad member positioned within the shroud and mounted to the shaft, wherein rotation of the shaft rotates the pad member and axial movement of the shaft moves the pad member relative to the open end of the shroud;

iii. a slurry input in fluid communication with the pad member;

iv. a slurry output in fluid communication with the pad member; and v. a seal member positioned at the open end of the shroud;

(e) wherein the slurry input is positioned on the housing at an end of the tool opposite the open end of the shroud, the slurry output is positioned on the shroud, and a vacuum release member is positioned at the slurry input; and further comprising a slurry cooling system comprising:

(a) an insulated housing member that defines a cavity, the cavity adapted to retain a volume of cooling material;

(b) a slurry carrying member having a coil section, an inlet end, and an outlet end, at least a portion of the coil section being positioned in the cavity in engagement with the cooling material, and the inlet and outlet ends being positioned outside of the cavity and accessible from an exterior of the housing member, and an interior lumen defined by the slurry carrying member being configured to retain a volume of slurry;

(c) a thermo switch, the thermo switch being configured to monitor a temperature of the slurry entering the inlet end and create a bypass of the coil section if the slurry temperature is outside a predetermined range of temperatures.

28. The scratch removal tool of claim 27, wherein the exterior of the housing member of the slurry cooling system has a cylindrical shape and at least a portion of the cavity has a cylindrical shape.

29. The scratch removal tool of claim 27, wherein the predetermined range of temperatures is about 80° F. to about 95° F., inclusive.

30. The scratch removal tool of claim 27, further comprising a slurry pumping system, comprising:

(a) a housing member that defines a cavity and an access opening, the cavity being adapted to retain a volume of slurry;

(b) a housing lid removably mounted to the housing member and configured to seal closed the access opening;

(c) a pump mounted to the housing lid and positioned outside of the cavity;

(d) a slurry input line having an open end in fluid communication with the volume of slurry;

(e) a slurry output line having an open end in fluid communication with the volume of slurry; and (f) a control assembly configured to control operation of the pump thereby controlling a pressure condition in the slurry output line.

31. The scratch removal tool of claim 30, wherein the slurry pumping system further comprises a pressure regulator, the pressure regulator providing pressure condition information to the control assembly.

32. The scratch removal tool of claim 30, wherein the slurry pumping system further comprises an aspirator, the aspirator being configured to generate a vacuum pressure condition in the housing member cavity.

33. A scratch removal tool, comprising:

(a) a motor;

(b) a housing;

(c) a rotatable shaft operably coupled to the motor and movable in an axial direction along a length of the shaft, wherein the shaft is hollow and configured to pass a fluid therethrough; and (d) a head assembly, including:

i. a shroud member having an open end;

ii. a pad member positioned within the shroud and mounted to the shaft, wherein rotation of the shaft rotates the pad member and axial movement of the shaft moves the pad member relative to the open end of the shroud;

iii. a slurry input in fluid communication with the pad member;

iv. a slurry output in fluid communication with the pad member; and v. a seal member positioned at the open end of the shroud;

(e) wherein the slurry input is positioned on the housing at an end of the tool opposite the open end of the shroud, the slurry output is positioned on the shroud, and a vacuum release member is positioned at the slurry input;

further comprising a slurry cooling system comprising:

(a) an insulated housing member that defines a cavity, the cavity adapted to retain a volume of cooling material; and (b) a slurry carrying member having a coil section, an inlet end, and an outlet end, at least a portion of the coil section being positioned in the cavity in engagement with the cooling material, and the inlet and outlet ends being positioned outside of the cavity and accessible from an exterior of the housing member, and an interior lumen defined by the slurry carrying member being configured to retain a volume of slurry; and further comprising a slurry pumping system, comprising:

(a) a housing member that defines a cavity and an access opening, the cavity being adapted to retain a volume of slurry;

(b) a housing lid removably mounted to the housing member and configured to seal closed the access opening;

(c) a pump mounted to the housing lid and positioned outside of the cavity;

(d) a slurry input line having an open end in fluid communication with the volume of slurry;

(e) a slurry output line having an open end in fluid communication with the volume of slurry; and (f) a control assembly configured to control operation of the pump thereby controlling a pressure condition in the slurry output line.

34. The scratch removal tool of claim 33, wherein the exterior of the housing member of the slurry cooling system has a cylindrical shape and at least a portion of the cavity has a cylindrical shape.

35. The scratch removal tool of claim 33, further comprising a thermo switch, the thermo switch being configured to monitor a temperature of the slurry entering the inlet end and create a bypass of the coil section if the slurry temperature is outside a predetermined range of temperatures.

36. The scratch removal tool of claim 35, wherein the predetermined range of temperatures is about 80° F. to about 95° F., inclusive.

37. The scratch removal tool of claim 33, wherein the slurry pumping system further comprises a pressure regulator, the pressure regulator providing pressure condition information to the control assembly.

38. The scratch removal tool of claim 33, wherein the slurry pumping system further comprises an aspirator, the aspirator being configured to generate a vacuum pressure condition in the housing member cavity.

39. A slurry cooling system adapted for use with a scratch removal device, comprising:

(a) an insulated housing member that defines a cavity, the cavity adapted to retain a volume of cooling material;

(b) a slurry carrying member having a coil section, an inlet end, and an outlet end, at least a portion of the coil section being positioned in the cavity in engagement with the cooling material, and the inlet and outlet ends being positioned outside of the cavity and accessible from an exterior of the housing member, and an interior lumen defined by the slurry carrying member being configured to retain a volume of slurry;

(c) a thermo switch, the thermo switch being configured to monitor a temperature of the slurry entering the inlet and create a bypass of the coil section if the slurry temperature is outside a predetermined range of temperatures.

40. The slurry cooling system of claim 39, wherein the exterior of the housing member has a cylindrical shape and at least a portion of the cavity has a cylindrical shape.

41. The slurry cooling system of claim 39, wherein the predetermined range of temperatures is about 80° F. to about 95° F., inclusive.

42. The scratch removal system of claim 10, wherein the slurry cooling system comprises:

(a) an insulated housing member that defines a cavity, the cavity adapted to retain a volume of cooling material; and (b) a slurry carrying member having a coil section, an inlet end, and an outlet end, at least a portion of the coil section being positioned in the cavity in engagement with the cooling material, and the inlet and outlet ends being positioned outside of the cavity and accessible from an exterior of the housing member, and an interior lumen defined by the slurry carrying member being configured to retain a volume of slurry.

43. The scratch removal system of claim 42, wherein the coil section has a cylindrically shaped portion, wherein the exterior of the housing member of the slurry cooling system has a cylindrical shape and at least a portion of the cavity has a cylindrical shape for receipt of the cylindrically shaped portion of the coil section.

44. The scratch removal system of claim 43, further comprising a thermo switch, the thermo switch being configured to monitor a temperature of the slurry entering the inlet end and create a bypass of the coil section if the slurry temperature is outside a predetermined range of temperatures.

45. The scratch removal system of claim 44, wherein the predetermined range of temperatures is about 18° F. to about 95° F., inclusive.

46. The scratch removal system of claim 43, wherein the slurry pumping system comprises:

(a) a housing member that defines a cavity and an access opening, the cavity being adapted to retain a volume of slurry to form the slurry reservoir;

(b) a housing lid removably mounted to the housing member and configured to seal closed the access opening;

(c) the pump mounted to the housing lid and positioned outside of the cavity;

(d) the slurry feed line having an open end in fluid communication with the volume of slurry;

(e) the slurry return line having an open end in fluid communication with the volume of slurry; and (f) a control assembly configured to control operation of the pump thereby controlling a pressure condition in the slurry output line.

47. The scratch removal system of claim 46, wherein the slurry pumping system further comprises a pressure regulator, the pressure regulator providing pressure condition information to the control assembly.

48. The scratch removal system of claim 46, wherein the slurry pumping system further comprises an aspirator, the aspirator being configured to generate a vacuum pressure condition in the housing member cavity.

* * * * *